US005568952A

United States Patent [19]

Ruegg

[11] Patent Number: 5,568,952

[45] Date of Patent: Oct. 29, 1996

[54] TAMPER RESISTANT SHACKLE SEAL WITH MULTIPLE LOCKING COMPONENTS

[75] Inventor: Erwin Ruegg, Tompkins Cove, N.Y.

[73] Assignee: Stoffel Seals Corporation, Tuckahoe, N.Y.

[21] Appl. No.: 537,393

[22] Filed: Oct. 2, 1995

[51] Int. Cl.[6] ..... B65D 55/06

[52] U.S. Cl. ..... 292/318; 292/307 A; 292/323

[58] Field of Search ..... 292/307 A, 307 R, 292/308, 311, 313, 318, 319, 323, 324

[56] References Cited

U.S. PATENT DOCUMENTS

| | | | |
|---|---|---|---|
| 1,219,046 | 3/1917 | Schultz . | |
| 1,326,291 | 12/1919 | Rothermel . | |
| 3,146,012 | 8/1964 | King, Sr. . | |
| 3,467,427 | 10/1969 | Moberg . | |
| 3,830,538 | 8/1974 | Moberg | 292/322 |
| 3,975,040 | 8/1976 | Van Gompel | 292/318 |
| 4,093,288 | 6/1978 | Suzuki . | |
| 4,424,994 | 1/1984 | Dowden . | |
| 4,588,218 | 5/1986 | Guiler et al. | 292/307 R |
| 4,609,218 | 9/1986 | Chevillard et al. | 292/320 |
| 4,614,373 | 9/1986 | Niemeijer | 292/318 |
| 4,676,535 | 6/1987 | Mautner . | |
| 4,929,006 | 5/1990 | Tsay | 292/324 |
| 5,056,837 | 10/1991 | Fuehrer | 292/307 R |
| 5,120,097 | 6/1992 | Fattori et al. | 292/318 |
| 5,125,700 | 6/1992 | Fattori et al. | 292/318 |

FOREIGN PATENT DOCUMENTS

| | | | |
|---|---|---|---|
| 0537400 | 10/1991 | European Pat. Off. . | |
| 0646943 | 11/1928 | France . | |
| 2072252 | 9/1981 | United Kingdom | 292/311 |
| 2164003 | 3/1986 | United Kingdom | 292/318 |
| 2205279 | 12/1988 | United Kingdom . | |

*Primary Examiner*—Steven N. Meyers
*Assistant Examiner*—Donald J. Lecher
*Attorney, Agent, or Firm*—Dowell & Dowell

[57] ABSTRACT

A shackle seal which includes a housing which is open at least at one end and which receives, through the open end, a bail or shackle strap having a plurality of spaced locking elements along at least a portion of the length thereof which are engagable by at least two locking cages, each of which includes flexible locking fingers for engaging the locking elements of the strap. A first of the locking cages is fixedly mounted adjacent the at least one opening in the housing while a second of the locking cages is movable within the housing so as to be selectively engagable with the locking fingers of the first cage.

19 Claims, 3 Drawing Sheets

TAMPER RESISTANT SHACKLE SEAL WITH MULTIPLE LOCKING COMPONENTS

BACKGROUND OF THE INVENTION

1. Field of the Invention

This invention generally relates to seals of the type which are utilized for security to provide clear evidence of tampering which include a housing connected to a strap member having an end portion which is receivable within the housing so as to be locked therein and wherein the strap or housing is severed or damaged to provide a visual indication of tampering in the event any action is taken to remove the end portion of the strap from the housing. More particularly, the present invention is directed to tamper-resistant security seals of the type in which a shackle has an end portion insertable within two or more locking cages supported within a housing in such a manner that two of the locking cages cooperate to prevent withdrawal of the strap unless sufficient force is applied to destroy a portion of the shackle strap or the housing to thereby provide a clear indication of tampering.

2. History of the Related Art

Tamper-indicating shackle seals are widely used where it is necessary to ensure that there has been no unauthorized entry or access obtained into secured areas. Such areas may include the contents of shipping containers, mail pouches, shipping bags, cargo trucks, international shipping containers and the like or may include meters, valves, storage areas, buildings and the like. Among the requirements for such seals is that they be easy to use, that they function readily to give a visual indication of unauthorized tampering of the seals and that they are inexpensive. One piece plastic seals are commonly used in a variety of industries in that they are easy to stock, are non-corrodable, are easy to place into service and are easily removable by authorized personnel when service is no longer required. Further, such seals are easy to stamp to provide identication to a specific seal placed into service for a specific use.

It is important, however, that tamper indicating seals must be durable enough to withstand ordinary handling, especially those which are utilized in the shipping and cargo industries. Ultimately, however, the value of such seals is determined by whether or not the structure of the seals provides a positive indication that no tampering has occurred. Therefore, such seals must give a visual indication of tampering in the event an unauthorized opening of a seal has been made.

The use of tamper indicating shackle seals which include a plastic housing having internal spring-like fingers which engage portions of a shackle or strap integrally formed with the housing is well known. Such seals must be designed so that the spring-like fingers of the housings engage the shackle or strap securely so that the shackle or strap cannot be withdrawn from the housing without physically damaging the housing or the strap. Most conventionally, the seals are designed so that a portion of the strap will sever, perhaps along a line of weakness or opening created in the strap, if force is applied to withdraw the shackle or strap from the housing. In other conventional structures, a portion of the housing may be designed to shatter or be distorted to give a visual indication of tampering when there has been an application of pressure or force to withdraw the shackle or strap from the housing. In yet other structures, a portion of the seal may become discolored by the application of force to the shackle or strap to thereby give a visual indication of tampering.

One drawback with some conventional plastic seals formed of polyethylene or polypropylene is that, through the application of heat, the material of the seal may be softened to a point where the shackle may be manipulated sufficiently to withdraw it from the housing without giving a permanent indication that such removal has occurred. This would allow access to the sealed contents of an enclosed area after which the seal could be reassembled.

To overcome this situation, developments were made wherein the locking fingers within the seal housings were separately molded of resinous material exhibiting a greater resistance to increased temperatures, such as nylon. Such structures not only allowed for a reduction in molding costs but also provided internal locking elements which could not be bypassed by the application of heat. See for instance, U.S. Pat. No. 5,056,837 to Fuehrer.

Other tamper indicating shackle seals have been designed to provide increased locking engagement between the housing and the shackle or strap of the seal. In British Patent No. 2,164,003 to Yap, a security seal is disclosed which includes a pair of internal locking members for engaging spaced locking elements or teeth associated with a strap. The seals are manufactured of a polypropylene or other material which displays evidence of tampering by changing color at points along the seal where stress is applied. Unfortunately, such a seal suffers from the shortcomings of other polypropylene seals with respect to the application of heat.

Many prior art tamper indicating shackle seals having a single inlet opening into a housing whereby the opposite end of the housing is sealed either integrally with the housing or by providing a separate plug. This type of structure prevents access into the area of the locking teeth of the housing through an end opposite the inlet end of the housing. However, in some instances, it is not possible to utilize closed end housings, especially where the seals must be drawn tightly around an object being secured such as the opposing handles of a closure or the neck of a flaccid container such as a mail pouch or bag. In these instances, both ends of the housing of the security seal must be open.

It has now been determined that in some instances, plastic tamper indicating shackle seals may be subject to tampering through the application of a freezing medium or a cooling spray which acts to harden the locking teeth in an open position. By urging the shackle or strap inwardly of the housing, the locking elements of the strap will expand the spring-like fingers within the housing to their maximum degree. At this point, if a coolant is applied to the housing to fix the spring-like fingers in an expanded position, in some instances, it is possible to actually withdraw the shackle from the housing to gain access to a restricted object or area.

In view of the foregoing, there is a need to ensure that tamper indicating shackle seals can be designed in such a manner that they cannot be tampered with by heating or cooling of the seal components.

SUMMARY OF THE INVENTION

The present invention is directed to a security seal having a bail or strap which is integrally molded with a housing in which at least two locking cages are mounted. The locking cages are aligned axially with an opening into the housing and the housing may further include an exit opening which is preferably axially aligned with the inlet opening. A first of the locking cages is fixedly secured within the housing adjacent the inlet opening and includes a plurality of yieldable or resilient locking fingers which are inwardly oriented or curved toward the axis of alignment and which are used to engage shoulder portions of locking elements molded in spaced relationship along at least a portion of the length of the strap. The second locking cage includes a plurality of locking fingers which are also engagable with the locking elements extending from the strap. The second cage, however, is movably mounted within the housing. The second locking cage is slidable within the housing so that, in a preferred embodiment, the second cage is spaced from the first cage when the strap is inserted with the locking elements extending through the cages until the locking fingers of the second cage engage the shoulder of one of the locking elements of the strap with the locking fingers of the first cage being slightly spaced from the shoulders of a spaced locking element of the strap. In this manner, the locking fingers of the first and second cages are engagable, at different times to provide a double lock with two spaced locking elements of the strap.

As the second cage is allowed to float within the housing, if any force is applied to the strap so as to urge the strap from the housing, the base of the second cage moves to abut the resilient locking fingers of the first cage to thereby urge the locking fingers into a positive locking and abutting relationship with the shoulders of an adjacent locking element of the strap, thus preventing the strap from being withdrawn through a narrowed opening defined to find by the resilient fingers. Further, the second cage positively retains the locking fingers in a locked relationship to thereby provide a third locking function to prohibit further withdrawal of the strap from the housing without severing the strap along a portion of its length to thereby give an indication of tampering.

In a preferred embodiment, a second opening is provided in the housing in general alignment with the inlet opening so as to allow a lead portion of the strap to extend therethrough so that the strap may be drawn tightly about an object to be secured.

Also, in the preferred embodiment, three spaced generally annular seats are provided in the housing which define three bores. Each of the cages includes a base portion having an annular flange which is seated in one of the annular seats. The annular flange of the first cage is welded or otherwise secured within the upper annular seat whereas the second or intermediate annular seat serves as a stop for limiting the movement of the second cage within a contact bore of the housing.

Also, in the preferred embodiment, the opening in the base of the second cage is defined by an inwardly tapering or beveled wall which serves to abut the tip portion of the inwardly tapered fingers of the first cage to thereby guidingly force the fingers of the first cage inwardly towards the shackle strap as the second cage is urged toward the first cage when any force is applied to withdraw the strap from the shackle housing, thus further ensuring a positive grip by the fingers of the first cage with a locking element of the strap.

It is a primary object of the present invention to provide a tamper indicating shackle seal which is molded of a plastic material and which includes a housing and a strap extending from the housing. The strap has a plurality of locking elements extending therefrom in spaced relationship with respect to one another along at least a portion thereof which locking elements are engagable with a pair of locking cages mounted within the housing in such a manner that any force attempting to withdraw the shackle strap from the housing causes the cages to engage with one another to thereby collapse locking fingers associated therewith to securely abut the locking elements of the shackle strap and thereby prevent the withdrawal of the strap from the housing without first fracturing the strap along a portion of its length.

It is also an object of the present invention to provide a tamper indicating shackle seal having at least two locking cages mounted within a housing of the shackle seal which are relatively movable with respect to one another so that each is engagable to prevent withdrawal of the shackle strap after the strap has been engaged within the housing of the seal.

It is also an object of the present invention to provide a tamper indicating shackle seal which cannot be tampered with through the application of heat or cold to the body of the seal so that the seal strap will become severed before the strap can be removed after it has been engaged within the housing of the seal.

It is also an object of the present invention to provide a shackle seal wherein the locking elements associated with the seal may be separately molded of a different material which is more resistant to the effects of change in temperature than the remainder of the seal, thereby allowing a reduction in molding costs while providing increased security over conventional tamper indicating shackle seals.

DESCRIPTION OF THE PREFERRED EMBODIMENT

Figure 4:
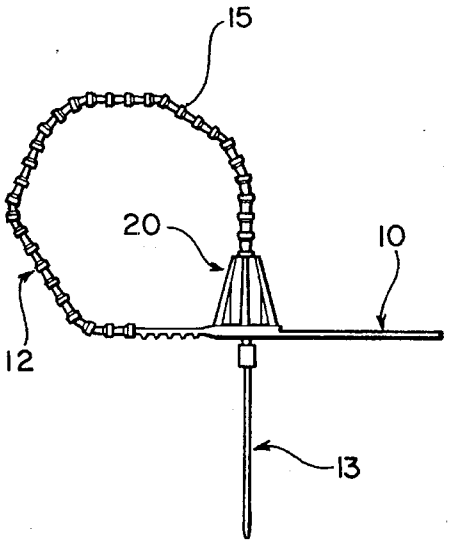
FIG. 4 is a side elevational view showing the shackle seal of FIGS. 1 through 3 as it would be configured in use with the strap of the seal inserted through the housing.
Figure 1:
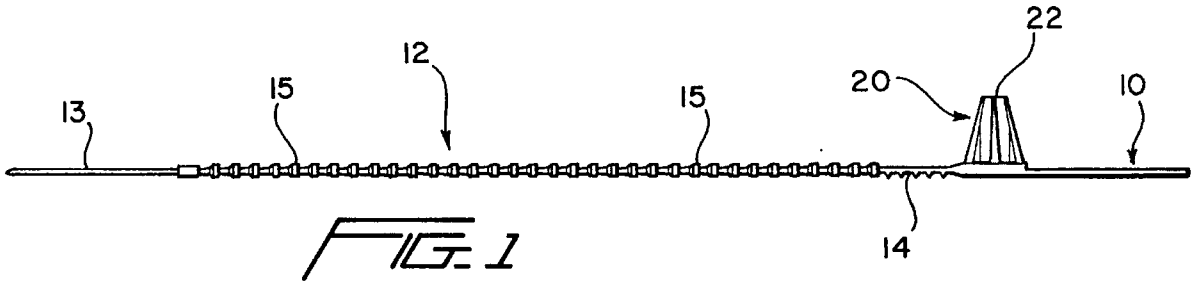
FIG. 1 is a side elevational view of the tamper resistant shackle seal of the present invention.
Figure 2:
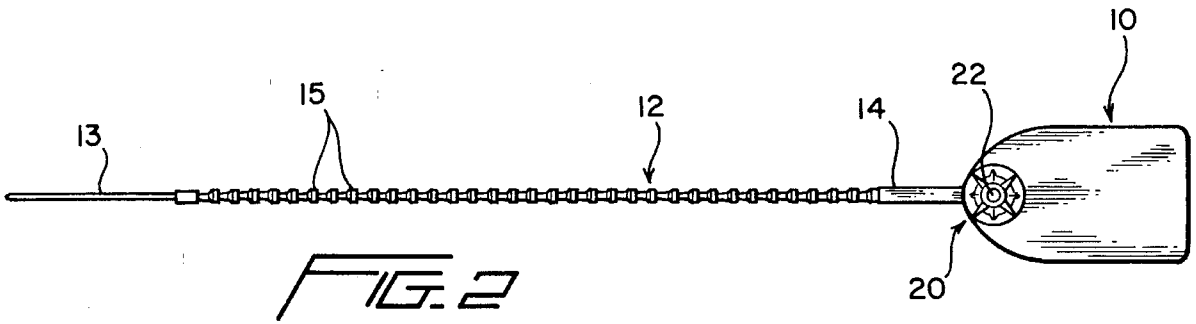
FIG. 2 is a top plan view of the tamper resistant shackle seal of the present invention.
Figure 3:
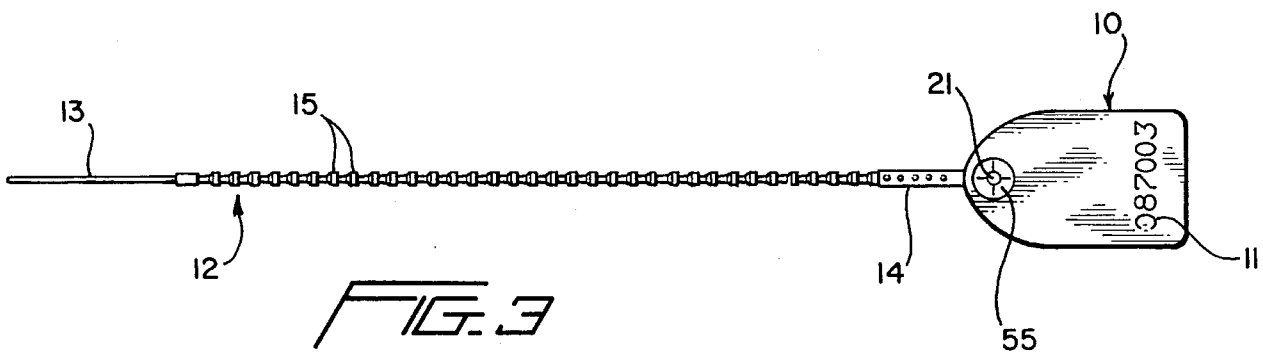
FIG. 3 is a bottom plan view of the tamper resistant shackle seal of the present invention.

With continued reference to the drawings, the tamper resistant shackle seal of the present invention includes a body portion 10 which is molded of a plastic material such as polyethylene or polypropylene and which is generally flat in configuration. Various identifying indicia 11 may be molded or stamped into one or more surfaces of the body portion. An elongated strap 12 is integrally molded with the body portion and extends outwardly from one end thereof. The strap includes a lead end 13, an inner portion 14 and an intermediate portion which includes a plurality of spaced locking elements 15. Each of the locking elements includes an outwardly extending annular rear shoulder 16 and a forwardly and inwardly tapered conical front wall portion 17. Each locking element 15 is connected to an adjacent locking element by way of integrally formed connecting portions 18 which have a cross-sectional diameter which is less than the diameter of the outwardly extending annular shoulder of the locking elements. In the preferred embodiment, the locking elements 15 be axially spaced relative to one another by a first generally uniform distance along the length of the intermediate portion of the strap.

Figure 5:
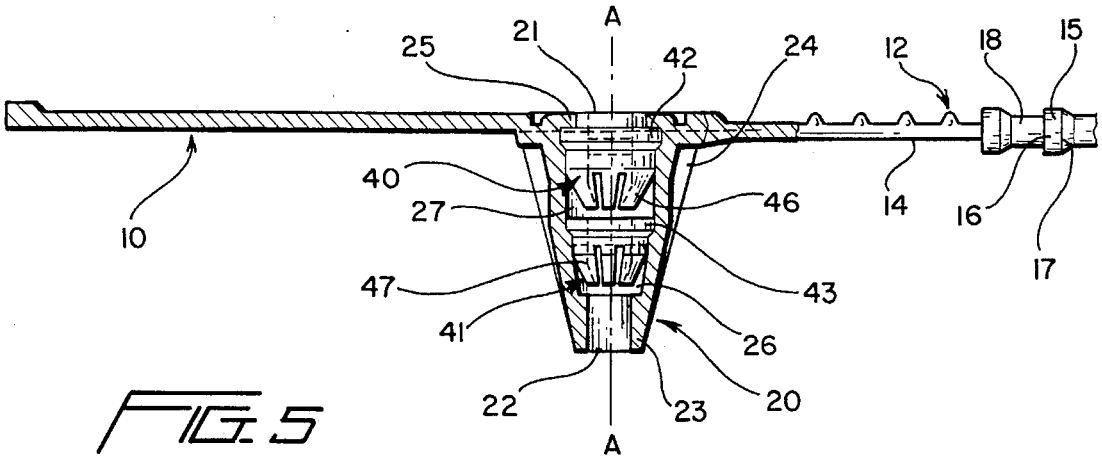
FIG. 5 is an enlarged, cross-sectional view taken through the housing of the shackle seal.
Figure 6:
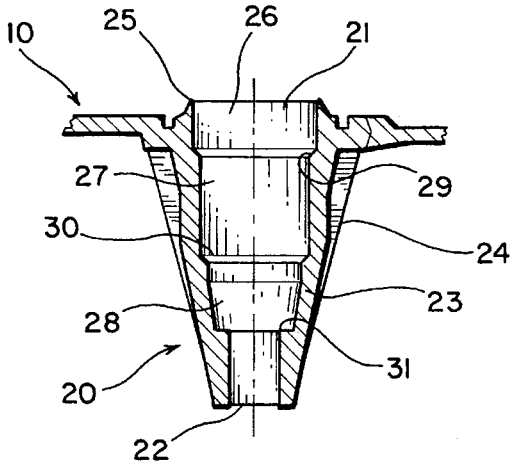
FIG. 6 is an enlarged, cross-sectional view of the housing shown in FIG. 5.

The strap is designed to be selectively receivable within a socket or housing 20 which is integrally molded with the body portion 10 and extends outwardly therefrom. In the embodiment shown in the drawing figures, the housing is generally conical in configuration, having an inlet opening 21 and an outlet opening 22 which are oriented on a common axis A—A centrally of the housing. As shown in FIGS. 5 and 6, the housing includes an outer wall portion 23 which is reinforced by a plurality of tapered flanges 24 which extend substantially along the entire length thereof. Although the housing is shown as being generally conical in outer configuration, the housing may take other cross-sectional or outer configurations.

In the preferred embodiment, the housing is molded so that an annular lip 25 is formed which extends outwardly from one side of the body on the opposite side of the body from the main portion of the housing. In addition, the housing is molded so as to form a series of chambers or bores 26, 27 and 28 which are concentrically oriented relative to one another along the axis A—A which communicate in alignment with the inlet opening 21 and outlet opening 22. A first inwardly extending annular flange 29 is formed between the inner bore 26 and the intermediate bore 27 and a second inwardly extending annular flange 30 is formed between the intermediate chamber 27 and the outermost chamber 28, for purposes which will be described in greater detail hereinafter. A further inwardly extending flange 31 is defined between the outermost chamber 28 and the outlet opening 22. As previously discussed, the body portion, strap and housing are preferably integrally formed of a synthetic resinous material having some resiliency such as polyethylene or polypropylene.

Figure 7:
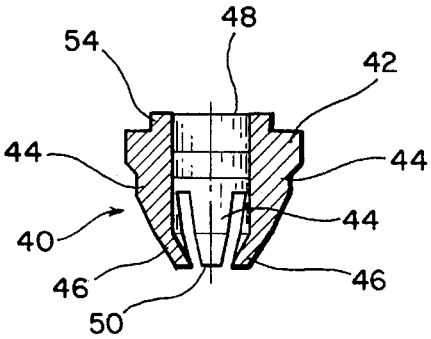
FIG. 7 is an enlarged, cross-sectional view of the first or fixed locking cage mounted in the housing of the shackle seal as shown in FIG. 5.
Figure 8:
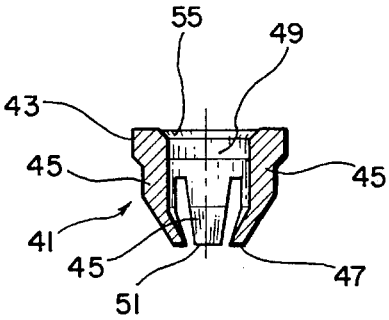
FIG. 8 is an enlarged, cross-sectional view of the second and movable locking cage shown mounted within the housing of the shackle seal of FIG. 5.

To securely engage the strap 12 within the housing 20, at least two separate locking assemblies or cages 40 and 41 are provided within the housing which are molded or formed of a resinous material having a higher melting point than the resinous material from which the housing and strap are molded. Suitable types of materials for forming the locking cages are long chain synthetic polymeric amides generally known as nylon. As shown in FIGS. 7 and 8, each locking cage 40 and 41 includes a generally outwardly extending annular base 42 and 43, respectively, from which extend a plurality of spaced locking fingers or elements 44 and 45, respectively. The outer end portions 46 and 47 of each of the locking fingers 44 and 45 are angled inwardly and include outer wall surfaces which taper inwardly toward the axis A—A of the housing when the locking cages are inserted therein, as shown in FIG. 5.

The annular base 42 and 43 of each of the locking cages 40 and 41 define openings 48 and 49 through which the strap may be inserted. The end portions 46 and 47 of the locking fingers 44 and 45 of each of the locking cages 40 and 41 extend inwardly to define restricted openings 50 and 51, respectively, which are of a size which is less than the diameter of the locking elements 15 of the strap. The locking fingers 44 and 45 are slightly resilient and are urged outwardly by the tapered portions 17 of the locking elements 15 as the strap is inserted therebetween. The end portions of the locking fingers will snap into engagement against the shoulder portions 16 as each locking element passes beyond the end portions 46 and 47 to thereby prevent the withdrawal of the strap in a reverse direction with respect to the locking cages, as is generally shown in FIGS. 9 through 12.

With specific reference to FIG. 7, locking cage assembly 40 includes an annular flange 54 which extends slightly outwardly from the base 42 thereof for purposes of which will be described in greater detail hereinafter. With specific referenced to FIG. 8, the opening 49 into locking cage 41 includes an inwardly tapering or beveled wall portion 55 which is provided for purposes of guiding engagement with the outer portions 46 of the locking fingers 44 of locking cage assembly 40 when the locking cages are inserted within the housing, also as will be described in greater detail hereinafter.

As previously discussed, it is preferred that the locking cage assemblies 40 and 41 be separately molded from the remainder of the shackle seal so as to reduce molding costs and also so as to allow the cages to be formed of a material which exhibits a higher melting point than the remaining portion of the seal, including the housing, strap and the body portion. With specific reference to FIGS. 5 and 6, locking cage 40 is designed to be fixedly secured within the housing so that the annular base 42 thereof is engaged within the bore 26. In the preferred embodiment, the annular base 42 of locking cage 40 is heat sealed or ultrasonically welded within the bore portion 26 by deforming the annular flange 25 of the housing over the outer portion of the annular base, thereby sealing the first locking cage between the flange 25 and the shoulder 29 between the inner bore and the intermediate bore of the housing. In this position, the base of the locking fingers 44 generally engage the side wall defining the bore 27 with the outer portions of the locking fingers 46 extending inwardly with respect to the bore and being flexible outwardly toward the side walls of the bore 27 as the strap is inserted therethrough.

Locking cage 41 is designed to be movably mounted within the bores 27 and 28 of the housing 20. Limitation of movement within the bores is controlled by the annular base 43 of the locking cage 41 engaging the shoulder 30 defined between the intermediate and outer bores 27 and 28, respectively. By allowing the locking cage assembly 41 to float or move within the housing, a unique three step locking sequence is established which prevents tampering with the shackle seal by the use of freezing or cooling sprays or liquids.

Figure 9:
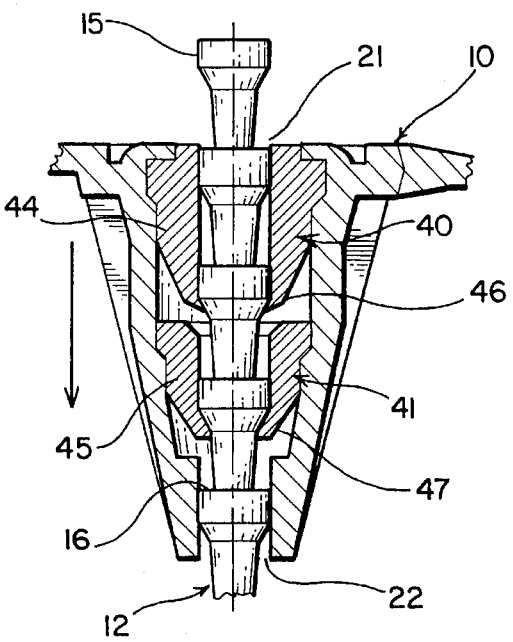
FIGS. 9 through 12 show sequentially the manner in which the fixed and movable locking cages of the present invention function to engage the strap of the tamper resistant shackle seal of the present invention with FIGS. 9 through 11 showing the strap at being inserted inwardly of the housing and FIG. 12 showing the positioning of the locking cages if pressure is applied to withdraw the strap from the housing.

With specific reference to FIGS. 9 through 12, the locking sequence of the shackle seal of the present invention is disclosed in greater detail. In FIG. 9, the end portion of the strap is shown as being inserted through the inlet and outlet openings 21 and 22 of the housing and through the locking cages 40 and 41. As shown, the locking fingers 44 and 45 of the locking cages flex outwardly as the locking elements or projections 15 of the strap pass therethrough with the locking fingers resiliently closing into position to engage the rear flange 16 of the locking elements to thereby prevent withdrawal of the strap from the housing without first breaking or severing the strap. In this respect, the dimensions of the strap, particularly along the inner and intermediate portions thereof, are such that the strap will break or sever if sufficient force is applied to break the locking fingers associated with either of the locking cages 40 and 41. If force is applied to pull the strap from the housing, the strap will be severed, thereby giving a clear indication that the seal has been tampered with. To facilitate severing, lines of weakness or openings may be provided along the length of the inner and intermediate portions of the strap as is conventionally known.

Figure 10:
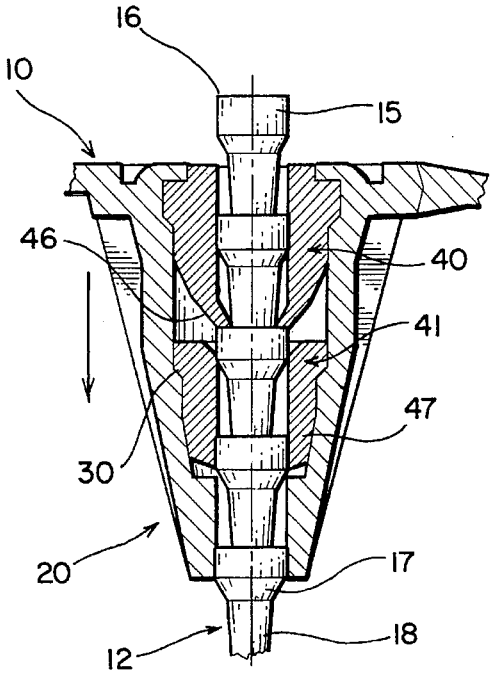
Figure 11:
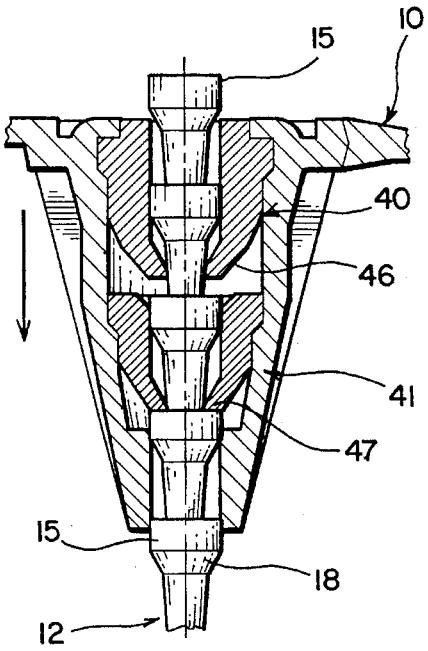

In FIG. 10, the strap has been inserted to a point where the end portions 46 of the locking fingers 44 of cage 40 engage the rear flange 16 of one of the locking elements 15. In this position, the movable locking cage assembly 41 is urged into engagement with the shoulder 30 within the housing and the end portion 47 of the locking fingers 45 have been deflected outwardly against the side walls of the housing. Continued movement of the strap inwardly of the housing, as shown in FIG. 11, results in the end portion 47 of the finger elements 45 of locking cage 41 engaging the rear shoulder 16 of another of the locking elements 15. In this position, the movable locking cage 41 is securing the strap within the housing. Again, if sufficient force is applied to the strap to pull it from the housing by destroying the locking fingers, the strap will first break, giving a clear indication of tampering.

Figure 12:
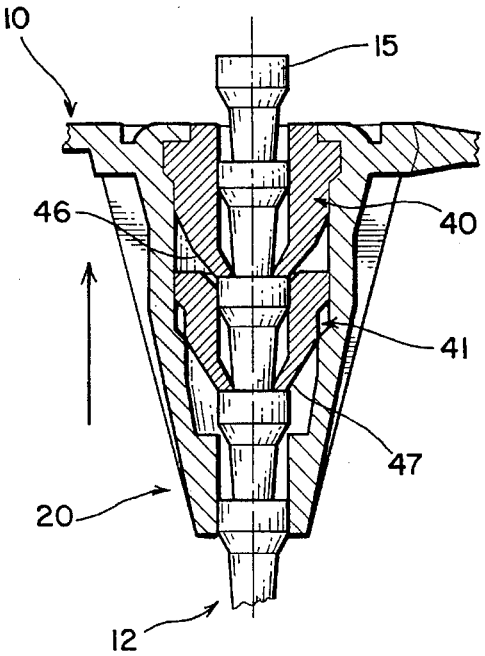

With specific reference to FIG. 12, if any force is applied to pull the strap reversely so as to withdraw it from the housing, the movable locking cage will be urged or forced by an adjacent locking element 15 toward the outer portions 46 of the locking fingers 44 of the fixed locking cage 40. As the base 43 of the movable locking cage 41 engages the outer portion 46 of the locking fingers 44, the fingers of the fixed locking cage will be forced against the shoulder of one of the locking elements 15, thereby ensuring that the strap cannot be pulled from the housing. To facilitate the manner in which the outer end portions 46 of the locking fingers 44 are positively forced into fixed engagement with the strap when force is applied to remove the strap from the housing, the beveled inner ledge 55 of the movable cage assembly 41 will guide the locking fingers of the fixed locking cage into closed engagement against the adjacent connector portion 18 of the strap, as is shown in the drawings.

In view of the foregoing, it is not possible to position the strap so as to open or extend the locking fingers of both of the locking cages 40 and 41 at the same time. Therefore, at least one of the locking cages is in a locked or closed position wherein the finger elements are closed against a connector portion of the strap. In FIG. 9, the locking fingers of the fixed locking cage 40 are spaced or open to allow passage of the strap whereas the locking fingers of the movable locking cage 41 are closed in a locked position. In FIG. 10, the reverse situation is shown and the locking fingers of the fixed locking cage are in a locked or closed position whereas the locking fingers of the movable locking cage are in an open position to allow passage of the strap. If an attempt is made to retain the locking fingers of the fixed locking cage in an open position, as shown in FIG. 9, by the application of a freezing agent in an effort to tamper with the placement of the strap, not only will the locking fingers of the movable seal be hardened in a locked configuration, but as the strap is urged from the housing, as is shown in FIG. 12, the movable locking cage 41 will physically abut the fixed locking cage thereby forcing the locking fingers 44 back into a closed or locked configuration, as shown, thus preventing unauthorized removal of the strap without severing the strap 12.

Although only two locking cages have been disclosed with respect to the preferred embodiment, it is anticipated that additional locking cages may be utilized and be within the teachings of the present invention. Such additional cages may be movable or fixed, depending upon design requirements. In addition, it is anticipated that in some embodiments, the outer end opening 22 of the housing may be sealed and that a strap may be utilized having an outer end portion which includes a plurality of spaced locking elements associated therewith. In such an embodiment, it would not be necessary for the strap to be inserted completely through the housing during use.

Also, in some embodiments, the fixed locking cage 40 may be molded together with the housing while a separate floatable or movable locking cage, such as 41, could be separately molded and could be inserted into the opposite end of the housing. Thereafter, the housing could be sealed to retain the movable or floating locking cage therein.

What is claimed is:

1. A tamper indicating security seal comprising a housing, a strap member extending from said housing, said strap member including at least two locking elements extending outwardly therefrom in spaced relationship with respect to one another, an inlet opening into said housing of a size to receive said strap member, a first locking means within said housing including a plurality of locking fingers having inwardly extending portions defining a restricted passageway, said inwardly extending portions of said locking fingers of said first locking means being configured to abut a first one of said locking elements of said strap member when said strap member is inserted within said housing to thereby resist the withdrawal of said strap member from said housing, a second locking means movably mounted within said housing and having a base defining an opening therethrough for selectively receiving said strap member and a plurality of spaced locking fingers having inwardly extending portions for selectively engaging a second one of said locking elements of said strap member when said strap member is inserted within said housing, said base portion of said second locking means being movable into engagement with said locking fingers of said first locking means when a force is exerted in a direction to withdraw said strap member from said housing to thereby urge said locking fingers of said first locking means toward said strap means.

2. The tamper indicating security seal of claim 1 wherein each of said first and second one of said locking elements are engaged with said inwardly extending portions of said locking fingers of said first and second locking means, respectively, when said second locking means is in engagement with said first locking means.

3. The tamper indicating security seal of claim 2 in which said base portion of said second locking means includes a beveled wall portion surrounding said opening therethrough, said beveled wall portion being engagable with said locking fingers of said first locking means when said second locking means is engaged therewith.

4. The tamper indicating security seal of claim 2 wherein said locking fingers of said first locking means and said base portion of said second locking means are disposed within a bore within said housing, and shoulder means extending into said bore for engaging said base portion of said second locking means when said second locking means is in spaced relationship with respect to said first locking means.

5. The tamper indicating security seal of claim 4 including a counterbore in axial alignment with said bore, said locking fingers of said second locking means being oriented within said counterbore when said second locking means is spaced from said first locking means.

6. The tamper indicating security seal of claim 5 including a first bore within said housing adjacent said inlet opening therein, said first locking means including a base portion fixedly mounted within said first bore, and an opening through said base portion of said first locking means of a size to receive said strap member.

7. The tamper indicating security seal of claim 6 in which said base portion of said first locking means is heat-sealed within said first bore.

8. The tamper indicating security seal of claim 5 in which said base portion of said second locking means includes a beveled wall portion surrounding said opening therethrough, said beveled wall portion being engagable with said locking fingers of said first locking means when said second locking means is engaged therewith.

9. The tamper indicating security seal of claim 5 including an outlet opening in said housing of a size to receive said strap member therethrough.

10. The tamper indicating security seal of claim 9 including a body portion extending from said housing adjacent said inlet opening therein.

11. The tamper indicating security seal of claim 10 wherein said housing is generally conical in configuration, and a plurality of reinforcing flanges extending along at least a portion of said housing.

12. The tamper indicating security seal of claim 5 in which each of said locking elements includes a tapered forward wall portion and a rear inwardly extending shoulder for engaging said inwardly extending portions of said locking fingers of said first and second locking means.

13. The tamper indicating security seal of claim 12 wherein said strap member includes an outer end portion and an inner end portion having an intermediate portion therebetween, said locking elements extending in spaced relationship with respect to one another along said intermediate portion.

14. The tamper indicating security seal of claim 5 in which said strap member is designed to fracture along a portion of its length when a force is exerted to withdraw said strap member from said housing when either of said first or second one of said locking elements is engaged with said inwardly extending portions of said locking teeth of said first and second locking means.

15. The tamper indicating security seal of claim 1 wherein said first and second locking means are molded of a first resinous material and said housing and strap member are molded from a second resinous material, said first resinous material having a greater resistance to heat than said second resinous material.

16. A tamper indicating security seal comprising a housing and a strap member extending outwardly relative to said housing to an outer end portion, an inlet opening into said housing of a size to selectively receive said strap member therethrough, said housing having first, second and third bores therein in general axial alignment with said inlet opening, a first inwardly extending shoulder between said first and second bores and a second inwardly extending shoulder between said second and third bores, a first locking cage means having a base portion fixedly mounted within said first bore and having a plurality of locking fingers extending into said second bore, said locking fingers of said first locking cage means including portions for engaging said locking elements of said strap member when said strap member is inserted therebetween so as to prevent the withdrawal of said strap member from said housing, a second locking cage means movable within said second bore from a first position spaced from said first locking cage means to a second position in engagement with said locking fingers of said first locking cage means, said second locking cage means including a base portion and a plurality of locking fingers extending outwardly from said base portion into said third bore, said locking fingers of said second locking cage means including portions for engaging said locking elements of said strap member when said strap is inserted through said second locking cage means, and said portions for engaging said locking elements of said strap member of said locking fingers of both said first and second locking cage means simultaneously engaging spaced locking elements of said strap member when said second locking cage means is in said second position.

17. The tamper indicating security seal of claim 16 wherein said bore portion of said second locking cage means includes an opening for receiving said strap member, and a beveled portion surrounding said opening.

18. A tamper indicating security seal comprising a housing and a strap member extending outwardly relative to said housing to an outer end portion, an inlet opening into said housing of a size to selectively receive said strap member therethrough, a first locking cage means having a base portion fixedly mounted within said housing and having a plurality of locking fingers, said locking fingers of said first locking cage means including portions for engaging said locking elements of said strap member when said strap member is inserted therebetween so as to prevent the withdrawal of said strap member from said housing, a second locking cage means movable within said housing from a first position spaced from said first locking cage means to a second position in engagement with said locking fingers of said first locking cage means, said second locking cage means including a base portion and a plurality of locking fingers extending outwardly from said base portion, said locking fingers of said second locking cage means including portions for engaging said locking elements of said strap member when said strap is inserted through said second locking cage means, and said portions for engaging said locking elements of said strap member of said locking fingers of both said first and second locking cage means simultaneously engaging spaced locking elements of said strap member when said second locking cage means is in said second position.

19. The tamper indicating security seal of claim 18 wherein said bore portion of said second locking cage means includes an opening for receiving said strap member, and a beveled portion surrounding said opening.

* * * * *